US005511973A

United States Patent [19]

Ray

[11] Patent Number: 5,511,973

[45] Date of Patent: Apr. 30, 1996

[54] IGNITION COVER AND VENTURI MOUNTING CLIP

[75] Inventor: Keith Ray, Delaware County, Ohio

[73] Assignee: Whirlpool Corporation, Benton Harbor, Mich.

[21] Appl. No.: 362,119

[22] Filed: Dec. 22, 1994

[51] Int. Cl.[6] ..... F24C 3/10

[52] U.S. Cl. ..... 431/191; 431/192; 126/39 E; 248/56

[58] Field of Search ..... 431/191, 190, 431/192, 193, 194, 283, 286; 126/39 E, 39 R, 39 K; 248/56, 75

[56] References Cited

U.S. PATENT DOCUMENTS

| | | | |
|---|---|---|---|
| 2,000,335 | 5/1935 | Kahn | 431/191 |
| 2,413,927 | 1/1947 | Robertson | 248/56 |
| 2,480,046 | 8/1949 | Reeves | 431/191 |
| 2,497,787 | 2/1950 | Minster . | |
| 2,878,862 | 3/1959 | Matthews et al. . | |
| 3,654,382 | 4/1972 | Rubright | 248/56 |
| 3,761,222 | 9/1973 | Lapins et al. | 431/191 |
| 3,806,306 | 4/1974 | Duperow et al. . | |
| 3,809,055 | 5/1974 | Craver . | |
| 3,922,138 | 11/1975 | Biddle et al. . | |
| 4,413,610 | 11/1983 | Berlik . | |
| 5,152,276 | 10/1992 | Brock et al. . | |

*Primary Examiner*—James C. Yeung
*Attorney, Agent, or Firm*—Hill, Steadman & Simpson

[57] ABSTRACT

A burner support arrangement for a domestic stove having a platform with apertures for receiving two burner tubes, and raised rails extending between the apertures and a central igniter. Snap on covers form igniter tubes with the raised rails. A support clip clasps the burner tubes and supports the burner tubes above the platform.

21 Claims, 4 Drawing Sheets

IGNITION COVER AND VENTURI MOUNTING CLIP

BACKGROUND OF THE INVENTION

The present invention relates to a gas appliance such as a stove and particularly to a burner lighting and firing arrangement including structure and mounting for a pilot flash tube and venturi tube.

It is known to provide a domestic stove burner arrangement having plural burners serviced by a single pilot ignition source. Such an arrangement is disclosed, for example, in U.S. Pat. No. 3,806,306. The ignition source is connected via "igniter tubes" or flash tubes to the individual burners. The burners are provided with burner tubes or "venturi tubes" to supply an air and gas mixture to the individual burners.

The igniter tubes have been constructed as tubes attached to the burner and pilot such as shown in U.S. Pat. No. 3,806,306. Also the tubes have been embossed into matching top and bottom stove base plate sheets such as disclosed in U.S. Pat. Nos. 3,922,138 and 2,497,787.

A simple construction using a single ply base plate sheet and attached covers is not known.

SUMMARY OF THE INVENTION

It is an object of the present invention to provide an effective yet easily assembled burner support for a domestic appliance including igniter or pilot cover, igniter tubes and venturi tube supports. It is an object of the invention to provide ignition tubes and igniter covers which are quickly installable and easily removable for cleaning. It is an object to provide a disassembleable support arrangement for burner venturi tubes which allows for quick removal for cleaning and easy reinstallation.

The objects of the invention are achieved by a burner support plate which accommodates a concave shaped cover fastened over a raised rail in the support to provide a disassembleable elongate igniter tube between an igniter or pilot and a burner venturi. The raised rail provides a concave trough at a top surface thereof which combines with a top region of the cover to form an approximately circular cross section tube.

The cover has a complex cross section with an upper region forming a portion of the circular cross section tube and bent off opposed side walls. Barbed clips extend from the sidewalls to engage lateral slots in the burner support plate. Additionally, an igniter guard can be applied over the igniter using similar barbed clips inserted in lateral slots through the support plate.

In operation, an air gas mixture flows from the selected burner and through the igniter tube to the pilot or igniter wherein the gas is ignited and flashes back to the burner where the gas flowing from the burner apertures is ignited in cascade fashion.

The invention also provides a mounting arrangement for a venturi tube for mounting a burner head. The venturi tube inserts through an aperture in the burner plate and the burner head is attached thereto. A novel support clip arrangement partially surrounds and clasps the tube. The support clip has a tab which interlocks into a slot through the venturi tube. The support clip has a resilient locking clip portion which locks to a thickness of the burner support plate within a rectangular notch area of the aperture to hold the tube vertically upright and laterally fixed in place.

The clip arrangement for both the ignition cover components and the venturi tube provide for cost effective assembly of a stove burner arrangement. The burner support plate need not be provided with separately attached, fully enclosed igniter tubes but instead can be stamp formed to accommodate the easily applied overlying covers.

An effective method of assembling the burner support is thus accommodated. The venturi tubes with pre-mounted support clips can be inserted upwardly through the apertures in the burner plate. The locking clip portion has an inclined surface which resiliently moves the venturi tubes laterally to properly locate support clip tabs to overlie the burner plate. The locking clip engages the burner plate when fully engaged. The igniter guard and covers can be attached to a top side of the burner plate either before or after the venturi tubes are attached. The burners can next be fitted over ends of the venturi tubes.

DETAILED DESCRIPTION OF THE PREFERRED EMBODIMENTS

Figure 1:
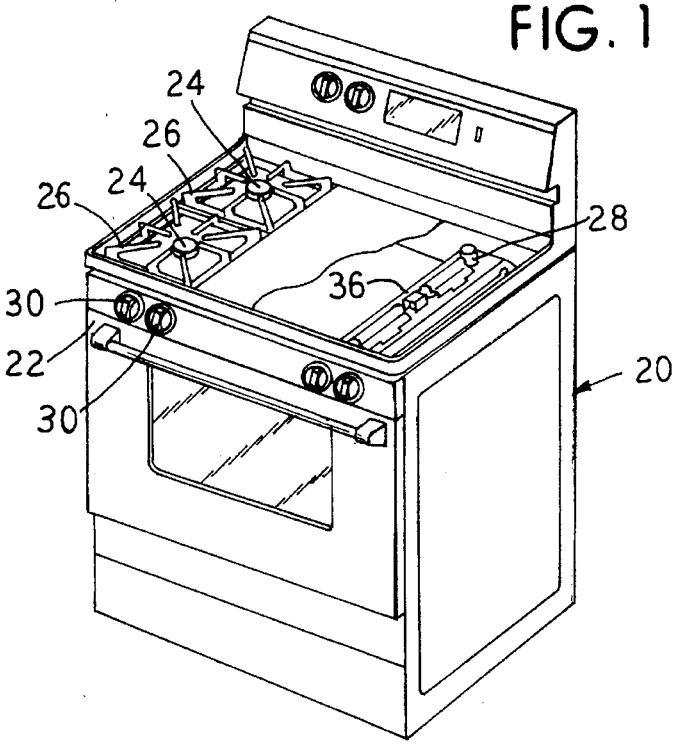
FIG. 1 is a perspective view of a domestic stove of the present invention with portions removed for clarity.

FIG. 1 illustrates a domestic stove 20 having a cooking surface 22 with typically four burners 24 (two shown) surrounded by grills 26. Each burner 24 is connected to a venturi tube 28 which is connected to a source of gas and air, having air mixing openings for providing a gas/air mixture to each burner 24. Each venturi tube 28 is connected to a selector valve 30. Such arrangements are described, for example, in U.S. Pat. Nos. 3,806,306 and 3,809,055 incorporated by reference. Under the surface 22 are arranged two burner supports 36 (one shown), each supporting two burners 24.

Figure 2:
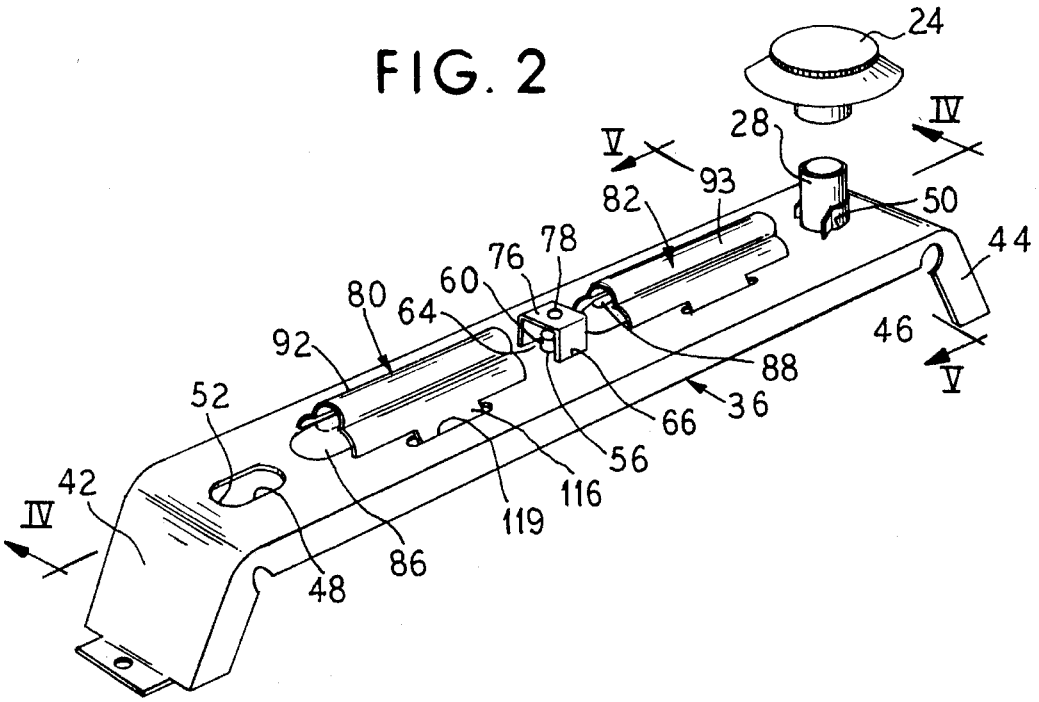
FIG. 2 is an exploded perspective view of a burner support of the present invention.

FIG. 2 illustrates a burner support 36 which has an elongated downwardly directed U-shape cross section with leg portions 42, 44 and platform portion 46. The platform portion has apertures 48, 50 each having an oblong shape with a square notch 52. In a central region, an aperture 56 is provided to receive a pilot gas tube or an electric igniter 60. Notches 64, 66 are arranged on opposite lateral sides of the aperture 56 to receive tabs (not shown) of a U-shaped pilot guard 76 which protects the flame of the pilot or alternately, the electrodes of the igniter. An air aperture 78 can be provided through a top of the cover 76.

Figure 3:
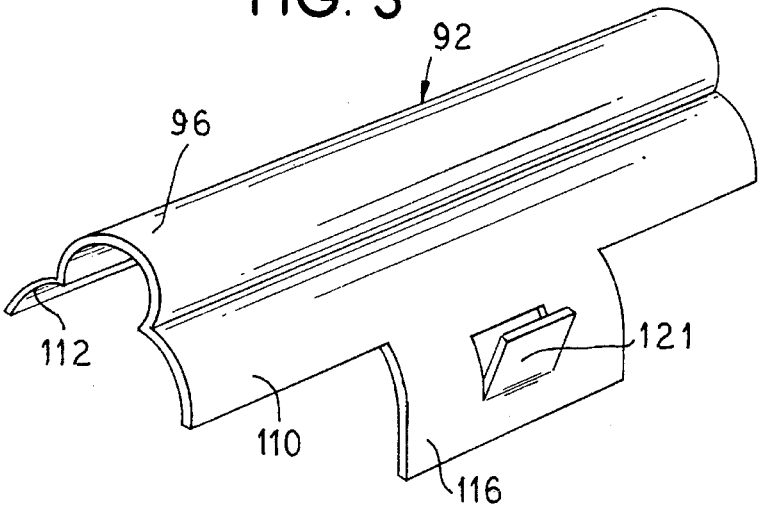
FIG. 3 is a perspective view of an ignition cover of the present invention.
Figure 4:
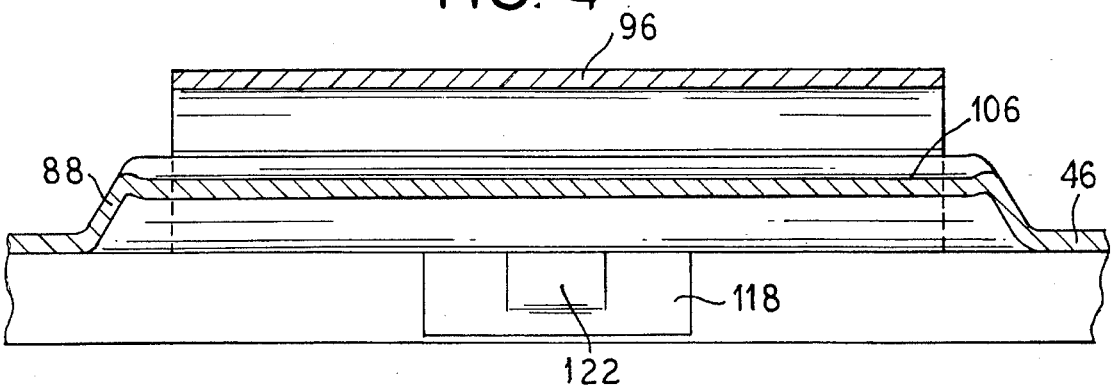
FIG. 4 is a sectional view of an ignition cover taken generally along lines IV—IV of FIG. 2.
Figure 5:
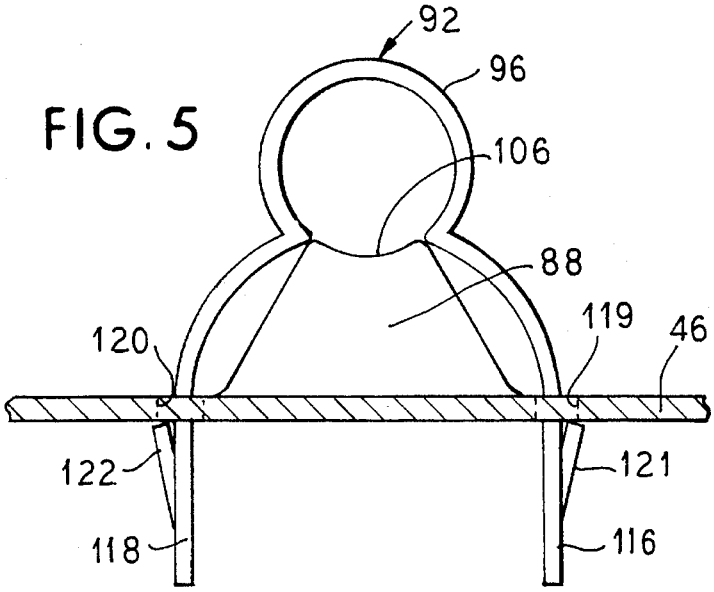
FIG. 5 is a partial sectional view taken generally along lines V—V of FIG. 2.

As illustrated in FIGS. 3–5, arranged on opposite longitudinal sides of the pilot are igniter tubes 80, 82. The igniter tubes function to transport the pilot flame to the igniter burners. The functioning of igniter tubes is known from, for example, U.S. Pat. No. 3,806,306. The igniter tubes are formed by cooperation of a raised rail 86, 88 stamped into the platform portion 46 and an overlying cover 92, 93 having a C-shaped portion 96 open downwardly toward the rail. The rail provides a concave shaped trough 106 (FIG. 5) open upwardly which together with the C-shaped portion 96 form a generally circular flash tube.

The cover 92 comprises side walls 110, 112 which extend obliquely from the C-shaped portion 96 to flushly abut the platform portion 46 along its respective length. Locking tabs 116, 118 extend from each side wall and are received into identical cover apertures 119, 120 arranged on opposite lateral sides of the rail. Barbs 121, 122 retain the tabs 116, 118 in place.

Figure 6:
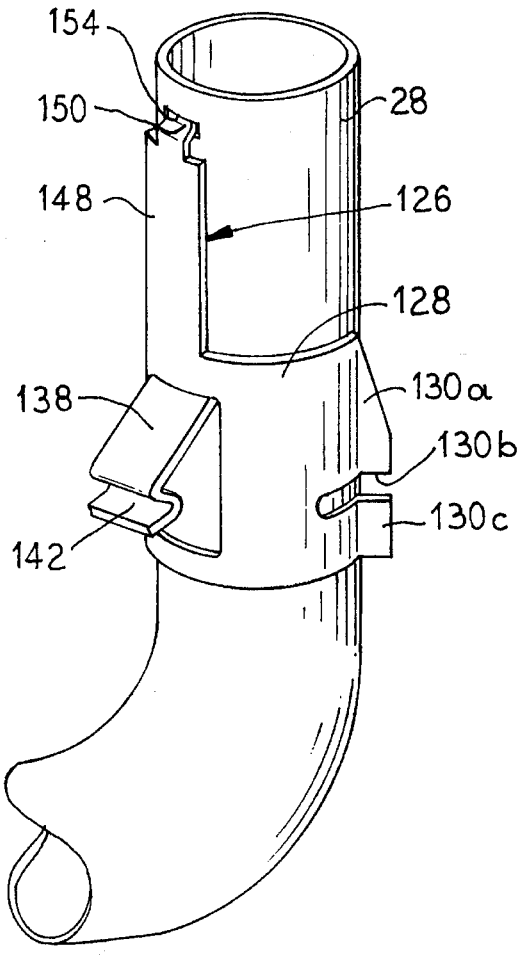
FIG. 6 is an enlarged partial perspective view of a venturi tube support shown in FIG. 2.
Figure 7:
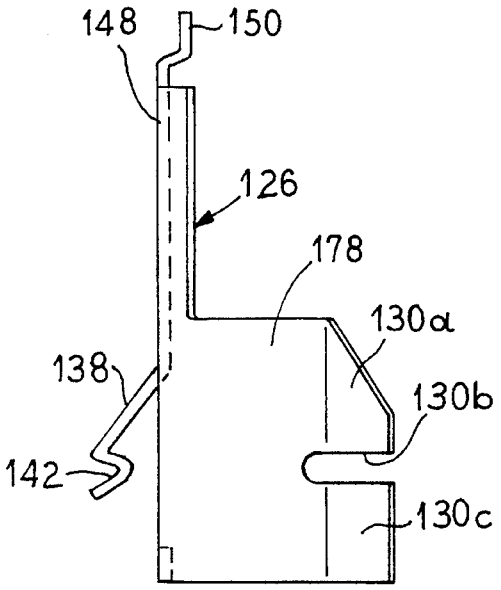
FIG. 7 is an elevational view of the venturi tube support clip shown in FIG. 6.

As shown in FIG. 2, adjacent the covers 92, 93 are the venturi tube apertures 48, 50 for receiving a gas venturi tube 28 therethrough from beneath the support 36. A burner head 24 is supported from the venturi tube. The apertures are configured to engage a support clip 126 (FIG. 6) fastened to the venturi tube.

As illustrated in FIGS. 6–9, the support clip 126 provides a C-shaped clasp 128 with bent off support tabs 130*a*, 132*a* for resting on the burner support platform portion 46. The support tabs are separated by notches 130*b*, 132*b* from retaining tabs 130*c*, 132*c*. The notch 132*b* and retaining tab 132*c* are not shown in FIGS. 6 and 7 but are configured in mirror image to the notch 130*b* and the retaining tab 130*c*. The clasp 128 circumferentially grips the venturi tube 28. Extending outwardly from the clasp 128 is an angled locking clip 138 having a U-shaped recess 142 open outwardly. Extending above the clip 138 is a finger portion 148 having an offset hook portion 150. The hook portion 150 engages into a rectangular slot 154 formed through the venturi tube.

Figure 8:
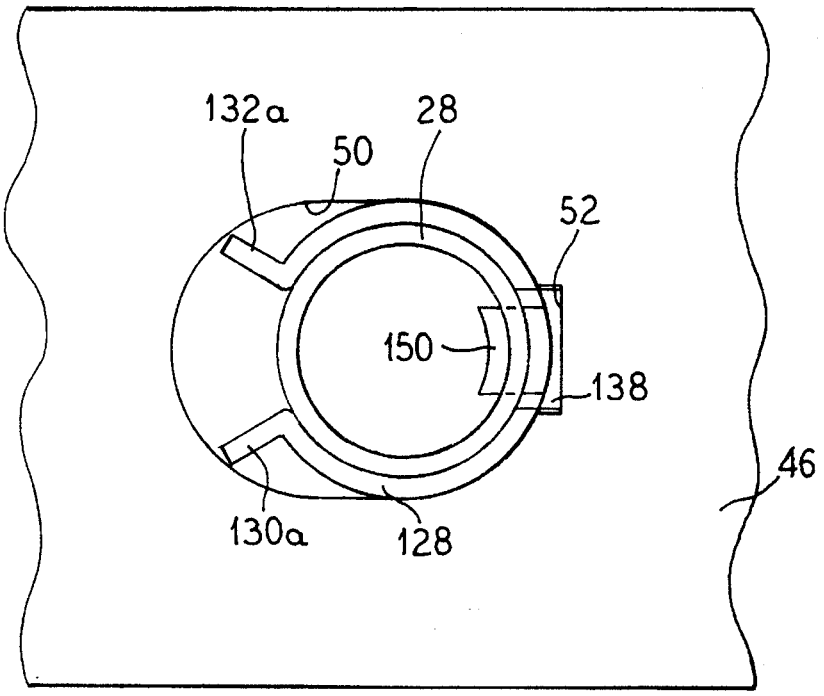
FIG. 8 is a partial plan view of the venturi tube support in a first stage of assembly.
Figure 9:
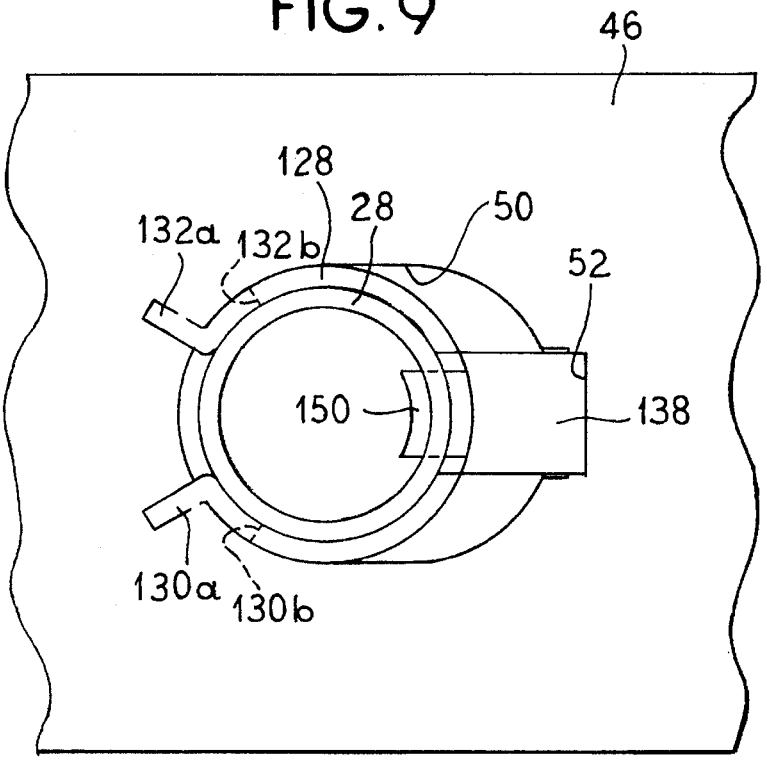
FIG. 9 is a partial plan view of the venturi tube support in a second stage of assembly.

FIGS. 8 and 9 illustrate the installation of the venturi tube 28 to the support 36. To install the venturi tube to the support 36, the hook portion 150 is engaged to the slot 154 and the clasp 128 is snapped onto the venturi tube. The assembly of tube and support clip 126 is inserted from below the aperture 48, 50 therethrough. As shown in FIG. 8, the support tabs 130*a*, 132*a* are threaded through the aperture at a wide portion thereof and as the locking clip 138 is depressed inwardly by force of the support 36 the tabs 130*a*, 132*a* are moved longitudinally, to overlie the platform portion 46 and the retaining tabs 130*c*, 132*c* are moved to underlie the platform portion 46 with the platform portion 46 captured in the notches 130*b*, 132*b*. The retaining tabs 130*b*, 132*b* prevent upward movement of the venturi tube 28. The locking clip 138 is depressed enough to allow the recess 142 to receive the edge of the platform portion 46 at the square notch 52. The recess 142 is at a same elevation as the notches 130*b*, 132*b*. The venturi tube is thus locked in place supported vertically by the tabs 130, 132 and the clip 138, as well as the hook portion 150 as shown in FIG. 9. The igniter covers 80, 82, the support 36, and the clip 26 can be stamped steel parts.

Although the present invention has been described with reference to a specific embodiment, those of skill in the art will recognize that changes may be made thereto without departing from the scope and spirit of the invention as set forth in the appended claims.

I claim as my invention:

1. A support for a gas fired appliance, said support arranged between an igniter and a burner, comprising;

a platform extending between said igniter and said burner;

an overlying cover having a concave portion, engageable to said platform to hold said concave portion contiguous to said platform to form an igniter tube between said igniter and said burner; and wherein said platform comprises a raised rail formed thereon having an upwardly facing concave trough, and said cover located having said concave portion overlying said trough.

2. A support for a gas fired appliance, said support arranged between an igniter and a burner, comprising:

a platform extending between said igniter and said burner;

an overlying cover having a concave portion, engageable to said platform to hold said concave portion contiguous to said platform to form an igniter tube between said igniter and said burner; and wherein said platform comprises an upwardly facing trough and said cover having said concave portion located overlying said trough.

3. The support according to claim 2 wherein said cover comprises two tab portions and said platform comprises two apertures, said tab portions engageable into said apertures to engage said cover to said platform.

4. The support according to claim 3 wherein said tab portions comprise barbed tabs which lock into said apertures.

5. The support according to claim 2, said platform further comprising a burner aperture adjacent an end of said igniter tube, said burner aperture being oblong shaped with a rectangular notch region and further comprising a clip structure supporting a burner tube which supports a burner, said clip structure having a locking clip portion for engaging said rectangular notch region.

6. A support for a gas fired appliance, said support arranged between an igniter and a burner, comprising:

a platform extending between said igniter and said burner;

an overlying cover having a concave portion, engageable to said platform to hold said concave portion contiguous to said platform to form an igniter tube between said igniter and said burner; and wherein said cover comprises two leg portions connected to said concave portion on opposite lateral sides thereof, and said platform comprises a first raised rail between said igniter and said burner and having an upwardly facing trough and said platform further comprises two first apertures on opposite lateral sides of said raised rail, said leg portions engageable to said platform at said first apertures to form said igniter tube between said concave portion and said trough.

7. The support according to clam 6 wherein said support is arranged between said burner and a second burner and said igniter is received in a central aperture of said platform and extends upward from said platform, and said platform comprises a second raised rail formed on said platform and having an upwardly concave second trough formed thereon, said platform having second apertures on opposite lateral sides of said second rail, and a second overlying cover having a second concave portion and two second leg portions on opposite lateral sides of said second concave portion, said second leg portions engageable into said second apertures to hold said second concave portion contiguous to said second concave trough to form a second igniter tube between said igniter and said second burner.

8. The support according to claim 6 wherein said igniter tube has a substantially circular cross section.

9. A support for a gas fired appliance, said support arranged between an igniter and a burner, comprising:

a platform extending between said igniter and said burner;

an overlying cover having a concave portion, engageable to said platform to hold said concave portion contiguous to said platform to form an igniter tube between said igniter and said burner; and wherein said burner is supported on a burner tube and said platform provides an aperture with a rectangular notch region for receiving said burner tube, and further comprising a clip structure for supporting said burner tube on said platform, said clip structure comprising a clasp portion for engaging said burner tube, tab portions for overlying said platform, and a locking clip portion for engaging said rectangular notch region of said burner aperture.

10. The support according to claim 9 wherein said clip structure further comprises a hook portion for engaging a notch formed in said burner tube.

11. A support for a gas fired appliance, said support arranged between two burners, and over an igniter, comprising:

a platform extending between said igniter and said burner;

a first raised rail formed on said platform and having a first upper concave trough formed thereon, said platform having first apertures on opposite lateral sides of said first rail;

a first overlying cover having a first concave portion and two first leg portions on opposite lateral sides of said first concave portion, said first leg portions engageable into said first apertures to hold said first concave portion contiguous to said first concave trough to form a first igniter tube between said igniter and said first burner, said igniter being received in a central aperture of said support and extending upward from said platform;

a second raised rail formed on said platform and having a second upper concave trough formed thereon, said platform having second apertures on opposite lateral sides of said second rail; and a second overlying cover having a second concave portion and two second leg portions on opposite lateral sides of said second concave portion, said second leg portions engageable into said second apertures to hold said second concave portion contiguous to said second concave trough to form a second igniter tube between said igniter and said second burner; and wherein said first and second leg portions comprise barbed tabs which insert into said apertures.

12. The support according to claim 11 wherein said platform is elevated by two platform leg portions on opposite longitudinal sides thereof.

13. A support for a gas fired appliance, said support arranged between an igniter and a burner supported by a burner tube, comprising:

a platform extending between said igniter and said burner;

an igniter tube located between said igniter and said burner on said platform;

said platform comprising a burner aperture adjacent an end of said igniter tube, said burner aperture being oblong shaped with a notch region; and a clip structure for supporting a burner tube from said platform, said clip structure comprising a clasp portion for engaging said burner tube, tab portions for overlying said platform, and a locking clip portion for engaging said notch region of said burner aperture.

14. The support according to claim 13 wherein said locking clip portion resiliently urges said tab portions to a position to overlie said platform, and said locking clip portion has a recess at an end thereof for engaging a thickness of said platform at said notch region.

15. The support according to claim 13 wherein said clip structure further comprises retaining tabs below said tab portions for underlying said platform.

16. A method of assembling a burner, igniter and igniter tube arrangement in an appliance comprising the steps of:

providing a platform for supporting the burner and igniter tube;

forming a raised rail on said platform, having a concave trough on its upper surface;

forming a burner aperture through said platform adjacent an end of said rail;

forming engaging apertures at opposite lateral sides of said rail;

forming a cover having a concave portion and two leg portions;

snap fitting said cover over said rail to form an igniter tube between said concave trough and said concave portion by inserting said leg portions into said engaging apertures;

providing a support clip for locking to said burner tube;

inserting said burner tube and support clip through said burner aperture from a bottom side thereof until said support clip substantially rests on a top side of said platform.

17. The method according to claim 16 wherein said step of forming a burner aperture is further defined in that said burner aperture is oblong shaped, and said step of providing a support clip is further defined in that said spring clip comprises a locking clip portion which urges said support clip to move in a horizontal direction when said support clip is moved vertically through said burner aperture such that portions of said support clip overlie said platform.

18. The method of claim 17 wherein said step of providing a support clip is further defined in that said locking clip portion provides a recess to engage a thickness of said platform when said support clip is horizontally moved into preselected position.

19. A support for a burner supported on a burner tube for a gas fired appliance, comprising:

a platform including a burner aperture said burner aperture being oblong shaped; and a clip structure for supporting a burner tube from said platform, said clip structure including a clasp portion for engaging said burner tube, a tab portion for overlying said platform, and a resilient locking clip portion for engaging said platform at said burner aperture when said tab portion overlies said platform.

20. The support according to claim 19 wherein said burner aperture comprises a notch region and said locking clip portion resiliently urges said tab portion to a position to overlie said platform, and said locking clip portion has a recess at an end thereof for engaging a thickness of said platform at said notch region.

21. The support according to claim 19 wherein said clip structure further comprises a retaining tab below said tab portion for underlying said platform.

* * * * *